United States Patent [19]

Leuenberger

[11] Patent Number: 4,926,514

[45] Date of Patent: May 22, 1990

[54] METHOD OF AND APPARATUS FOR REMOVING STAINS FROM SOILED AREAS OF A PLANNAR TEXTILE ARTICLE

[75] Inventor: Hans Leuenberger, Bottighofen, Switzerland

[73] Assignee: Biac Holding AG, Kreuzlingen, Switzerland

[21] Appl. No.: 299,474

[22] Filed: Jan. 18, 1989

[30] Foreign Application Priority Data

Jan. 18, 1988 [CH] Switzerland ..... 163/88
May 20, 1988 [CH] Switzerland ..... 1926/88

[51] Int. Cl.[5] ..... D06B 1/02; D06B 5/24

[52] U.S. Cl. ..... 8/150; 8/158; 15/321; 68/20; 68/205 R; 68/240; 239/305; 239/562; 239/578

[58] Field of Search ..... 68/20, 205 R, 222, 240; 8/149.1, 150, 158; 15/321; 239/304, 305, 562, 563, 578

[56] References Cited

U.S. PATENT DOCUMENTS

| | | | |
|---|---|---|---|
| 2,301,227 | 11/1942 | Pickett, Jr. et al. | 68/240 X |
| 2,606,069 | 8/1952 | Hutchins et al. | 239/305 X |
| 2,686,694 | 8/1954 | Freeman | 68/240 X |
| 2,707,874 | 5/1955 | Glover, Jr. | 68/240 X |
| 2,807,503 | 9/1957 | Buterbaugh | 68/222 X |
| 3,139,238 | 6/1964 | Norstrud et al. | 239/305 X |
| 3,500,666 | 3/1970 | Calcaterra | 68/240 X |
| 3,663,984 | 5/1972 | Anthony et al. | 15/321 |
| 3,705,437 | 12/1972 | Rukavina, Jr. et al. | 15/321 X |
| 3,909,197 | 9/1975 | Cremers | 15/321 X |
| 4,443,909 | 4/1984 | Cameron | 15/321 X |
| 4,530,131 | 7/1985 | Zell et al. | 15/321 |

*Primary Examiner*—Philip R. Coe
*Attorney, Agent, or Firm*—Diller, Ramik & Wight

[57] ABSTRACT

The area which is to be cleaned is intially subjected to a pulsating jet of a liquid which penetrates through the area and which liquid contains a cleaning agent. Thereafter the area is rinsed by a pulsating jet of water which also penetrates through the area. Accordingly, the dirt gets dissolved and a mechanical working of the respective area is achieved simultaneously with a rinsing away of the dirt. Immediately thereafter the now wet area is penetrated by a hot pressurized air jet such to achieve a driving away of the dampness and accordingly a complete drying. If necessary, above sequence is repeated. Due to the speedy drying a forming of rings at the cleaned area is prevented and it is immediately possible to see if a visually complete cleaning has been achieved.

26 Claims, 4 Drawing Sheets

Fig. 2
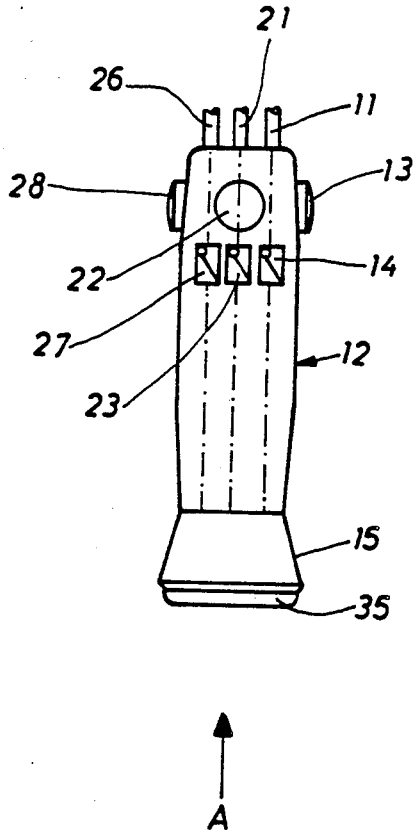
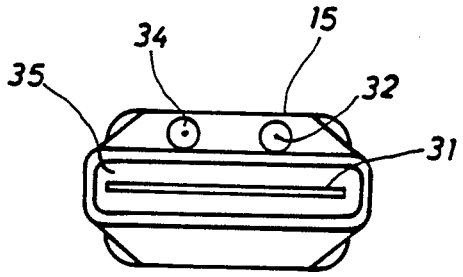
Fig. 3

METHOD OF AND APPARATUS FOR REMOVING STAINS FROM SOILED AREAS OF A PLANNAR TEXTILE ARTICLE

BACKGROUND OF THE INVENTION

1. Field of the Invention

The present invention relates to a method of removing stains from soiled areas of a planar textile article. It also relates to apparatus for removing stains from soiled areas of a planar textile article.

2. Description of the Prior Art

It is generally known to remove dirt from planar textile articles by spraying by means of a so-called spot cleaning gun a spot removing agent onto the soiled area. The object of the spot removing agent is to dissolve the dirt and to rinse such dirt out of the e.g. weaving making up such textile article. Thereafter air is blown against the now damp area in order to let it dry.

A drawback of this procedure is that the vapors of the spot removing and dissolving agents generate an environmental hazard and a health hazard for persons working in the room, in which such cleaning is carried out. The vapors of the solvents as well as the residues of the dirt dissolving agents are often removed by a drawing off operation. Hereby the residues, however, of the solvents must be treated by special procedures prior to a final discharging thereof. Such treating is generally made by means of an activated charcoal filter, in which the cleaning is carried out. The activated charcoal, however, must in turn be cleaned or purified, respectively. To this end, the activated charcoal is washed by means of steam and the waste water formed thereby must be given again in turn a special refuse treatment. This entire procedure necessitates a relatively large operational expenditure and leads to considerable costs. Furthermore, after a cleaning of a textile fabric clearly recognizable dirt rings appear, which surround the cleaned area.

SUMMARY OF THE INVENTION

Hence, it is a general object of the present invention to provide a new method of and new apparatus for removing spots from a planar textile article without having to resort to solvents posing an environmental hazard and which achieve a visually impeccable cleaning without the danger of forming visually recognizable rings around a respective cleaned area.

A further object of the invention is to provide a method of removing stains from soiled areas of a planar textile article, according to which a soiled area of such planar textile article is placed in a stretched condition over a water and air penetrable support; whereafter the soiled area is mechanically worked at least once by a jet of at least one pressurized liquid by directing said jet against the soiled area such to cause the jet to penetrate therethrough, whereby dirt which caused the staining is torn away from the stained area and dragged or swept, respectively, along by the jet; followed immediately thereafter by exposing the area to a pressurized air jet such to have the air jet penetrate therethrough, whereby liquid is expelled and driven away from said section and an immediate drying thereof is reached.

A further object of the invention is to provide an apparatus for removing stains, soiled areas of a planar textile article, which apparatus includes a water and air penetratable support intended for a supportingly receiving of a soiled area of such textile article; a means for producing and discharging of a pressurized hot water jet to be directed against the soiled area of such textile article placed onto the support; a means for producing and discharging of a pressurized air jet to be directed against the soiled area of such textile article placed onto the support; and a means for producing an induced draught operative to draw off at least the water which has been directed to the soiled area.

Yet a further object of the invention is to provide an apparatus for removing stains from soiled areas of a planar textile article, which apparatus comprises a water and air penetratable support intended for a supportingly receiving of a soiled area of such textile article; at least one means for producing and discharging of a respective jet of a pressurized liquid directed against the soiled area of the textile article stretched over the support; and a means for producing and discharging of a pressurized air jet to be directed against said soiled area of such textile article placed onto the support.

In accordance with a preferred embodiment the respective jets of a pressurized liquid are emitted in form of a pulsating sharp jet, to which end a piston pump or diaphragm pump is used. The effect of the sharp jet of the hot pressurized liquid impinging on the soiled area is a mechanical working of such soiled area.

An as fast as possible and complete drying of the respective area is of decisive significance. The temperature of the pressurized air is preferably chosen to be as high as possible, dependent only on the respective properties of the material being treated. A speedy and complete drying of the respective area is achieved, in that the drying air is positively pressed through this area of the planar textile article. The respective area is not blown against only on its surface such as known in the prior art.

A complete removal of a soiling or spot, respectively, at e.g. woven textile articles can be seen only if such article is completely dry.

The longer a liquid acts onto the material of the planar textile article, here e.g. a weaving, the larger will be a swelling of the accordingly soaked article, specifically in case of natural fibers. This swelling can be avoided by a speedy and thorough drying. Furthermore, when the dwell time of a liquid, e.g. of water, in a weaving is too long, a detrimental influence on the finishing and dyes may be suffered. The finishings may be damaged and the dyes may be "bled out". Both effects lead to qualitative and/or visual deficencies.

The pressurized air which flows completely through the weaving allows now for the first time to avoid the known forming of boundary rings when cleaning a material. A wet area of the material incorporates a number of areas having different conditions. The central middle area of the entire area which has been cleaned and is wet is soaked to such a large extent that the spaces between the yarns forming the individual meshes of a weaving of a textile article or of the knitted fabric is completely filled by liquid.

This central area is surrounded by a further area, in which the meshes are only partly filled by liquid, namely along their edges. This is an effect which is known as such and which is due to the surface constraint of a liquid, i.e. e.g. water. Accordingly, there is an opening in the center of these meshes of this second area.

This second area is in turn surrounded by an outer area. The yarns or threads, respectively, of the weaving or knitting of this area are wet, but only the yarns or threads and not the interstices at the individual meshes are wet. These interstices are therefore empty.

If now cold or warm air would be blown against this wet area consisting of the three above described sub-areas in accordance with the prior art, i.e. if an air jet having a relatively high air volume and relatively low pressure is blown against such area or then if a suction or draught device is used which provides a relatively low suction force, by means of which air is drawn through the area to be dried, the following effect would happen:

The flowing air would flow only at such places through the article where the meshes are empty (i.e. not shut off by the liquid present) or air where the meshes are only partly filled by the liquid. Conclusively, the air will flow completely around the center area featuring the completely closed meshes. The conclusion thereof is, however, that the outermost sub-area, i.e. only the outer areas of the complete area which is to be dried will be practically completely dried before the drying at the innermost area will begin at all.

It is generally known in the art that if only soiled areas (not an entire article) is cleaned, not the entire dirt, i.e. the respective material forming the dirt, may this material be present in a solid, liquid or more or less viscous condition, is transported or rinsed, respectively, out of such weaving or knitting. A larger part of this dirt, i.e. what the human eye recognizes optically as a disturbing spot is merely thinned out during the so-called cleaning and remains more finely distributed in such weaving or knitting etc., whereby the extent of this thinning of the soil is merely such that the human eye does no longer recognize the spot, i.e. a person viewing the area in question recognizes such area optically clean.

It must now be noted, that the dirt particles or the material forming or causing, respectively, the soiling is suspended in the cleaning water or forms a solution in the cleaning water. Conclusively, the dirt is transported by this water. When now the wet spot expands as is well known, such dirt is transported inter alia laterally towards all sides and during the above mentioned drying this dirt is transported again back in the direction of the center of the spot.

It is generally known that after cleaning certain textile materials so-called "rings" remain on the material. These rings are produced because the entire wet spot or area, respectively, is not dried uniformly and rather in steps. Initially only those areas are dried, at which the air stream can flow through the meshes and it is only thereafter that the area is dried which had the completely closed meshes. During the known drying procedure the remaining dirt is transported by the liquid back to the border area between the closed and the open meshes and is deposited at that border area forming the above mentioned visible ring.

By means now of the pressurized air treatment in accordance with the invention, which treatment is based preferably on an application of an as high as possible air pressure and an as high as possible air temperature (depending on the respective material), the air flow which is pressed through the textile article by an extremely high force will dry the center area and the peripheral areas practically simultaneously and extremely speedily such that a concentrated depositing of the residual soil can no longer happen and this soil (so far as, if at all, remaining) remains uniformly distributed (i.e. no longer visible for the human eye).

BRIEF DESCRIPTION OF THE DRAWINGS

The present invention will be better understood and objects other than those set forth above will become apparent when consideration is given to the following detailed description thereof. Such description makes reference to the annexed drawings, wherein:

FIG. 2 is a side view of a treatment tool of the apparatus illustrated in FIG. 1;

FIG. 3 is a view in the direction of the arrow A of the treatment tool illustrated in FIG. 2;

DESCRIPTION OF THE PREFERRED EMBODIMENTS

Figure 1:
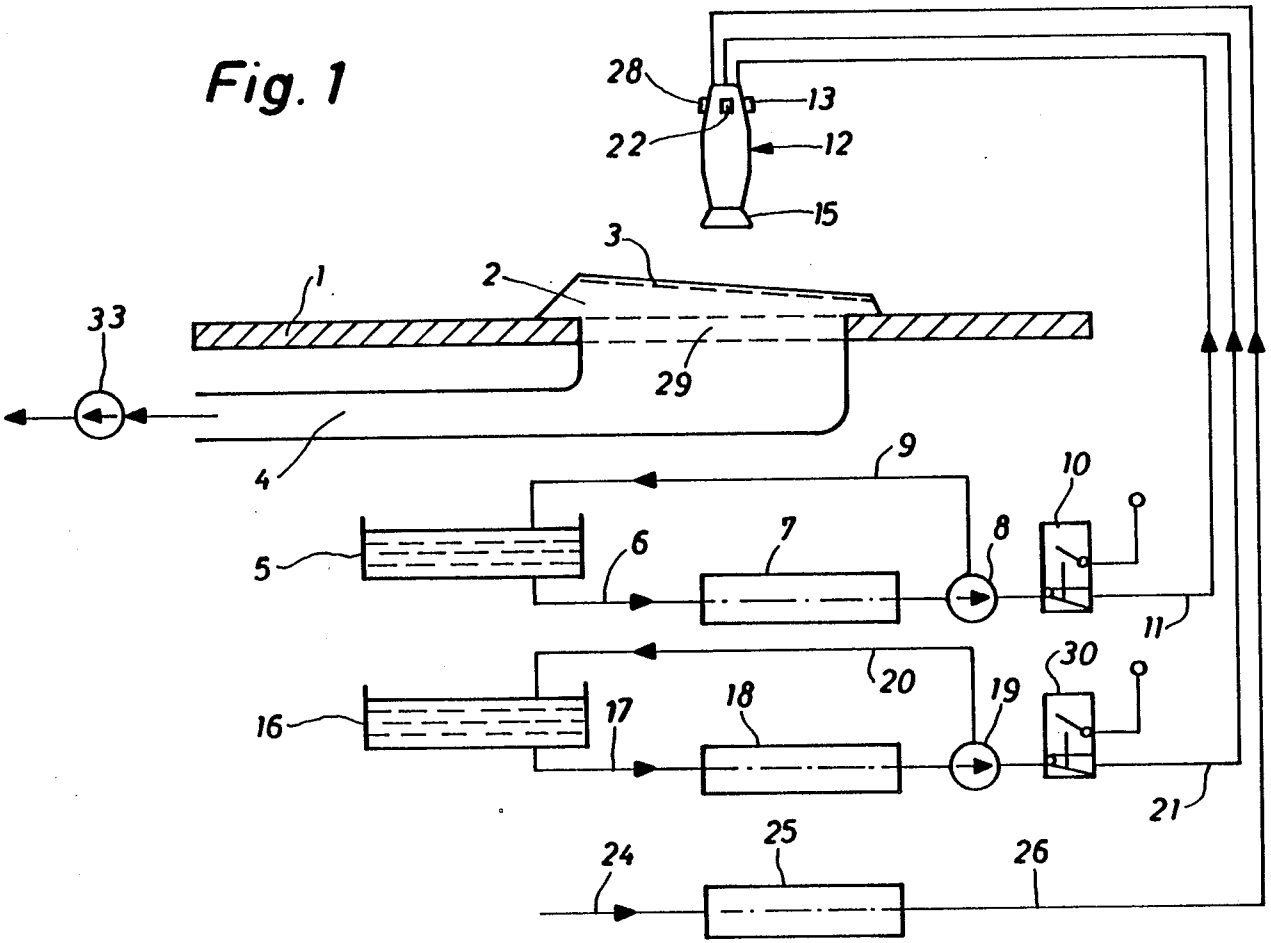
FIG. 1 illustrates schematically an exemplary embodiment of an apparatus for practising the inventive method.

Reference numeral 1 identifies in the figures generally a working table. A pedestal 2 is located on this working table 1 and the side walls of this pedestal 2 are more or less airtight and water- or liquid, respectively, tight. A wire mesh 3 is stretched over this pedestal 2 and covers its entire top. The pedestal 2 and the wire mesh 3 form together a support for receiving the planar textile article, e.g. a section of a weaving, which must be cleaned and will be placed onto the wire mesh 3. A through passage 29 is formed in the working table 1 under the pedestal 2, which through passage 29 is adjoined by a suction channel 4 extending to a source which generates a subatmospheric pressure, which generates a draught.

A water tank 5 is placed under the working table 1. A pipe run 6 is mounted to this water tank 5. This pipe run 6 extends to a water heating device 7, in which the water flowing out of the water tank 5 is heated up to a temperature controlled to correspond to a preset value. The water flows thereafter to a pump 8. In this exemplary embodiment this pump is a piston pump. The drive of the piston of this pump proceeds via an oscillating armature 37 see FIGS. 4 and 5). The design of such pumps is generally known and will, therefore, not be described in detail. A return pipe 9 runs from this pump 8 back into the water tank 5. A pressure switch apparatus 10 is located at the outlet of the pump 8. This pressure switch apparatus 10 senses the pressure of the water at the outlet of the pump 8 and is provided with a switch which controls the switching on and switching off, respectively, of the pump 8, depending on the prevailing pressure measured. A pressurized waterline 11 runs from the pump 8 to a treatment tool 12 which is guided and operated manually. The treatment tool 12 is provided with a shut-off device 14 of generally known design and which is operated by a schematically drawn push button 13. By means of operating this push button 13 the feeding of the hot pressurized water can selectively be switched on and switched off, respectively.

The apparatus in accordance with the FIGS. 1 to 3 includes furthermore a tank 16 located under the working table 1, which tank 16 contains a cleaning liquid having a low lathering power. Such cleaning liquids are also generally known and available on the market such that no detailed description thereof is necessary. A pipe run 17 is mounted to this tank 16. This pipe run 17 extends to a further heating device 18, in which the liquid flowing out of the tank 16 is heated to a temperature which is controlled to a predetermined value. The liquid flows from the heating device 18 further to a pump 19. In this embodiment described this pump 19 is a piston pump. The drive of the piston of the pump proceeds thereby via an oscillating armature. The design of such pumps is generally known and will, therefore, not be described more in detail. A return pipe 20 extends from this pump 19 back into the tank 16. A pressure switch apparatus 30 is mounted at the outlet of the pump 19. This pressure switch apparatus 30 feels the pressure of the liquid at the exit or outlet, respectively, of the pump 19 and is provided with a switch which dependent on the prevailing pressure controls the switching on and switching off, respectively, of the pump 19. A pressurized liquid line 21 extends from the pump 19 to the treatment tool 12 (FIG. 1). A further shut-off device 23 of known design and to be operated by a push button 22 is located in this treatment tool. By operating of the push button 22 the feeding of the cleaning liquid can be switched on and switched off by the operator.

In all embodiments pressurized air is fed by a pressurized air line 24, whereby the source of the pressurized air is not specifically designed in the drawings. Such source may be, for instance, an air pump of known design. The pressurized air line 24 extends to an air heating device 25. This air heating device 25 is, however, not necessarily provided in all foreseen embodiments of the present invention.

Figure 4:
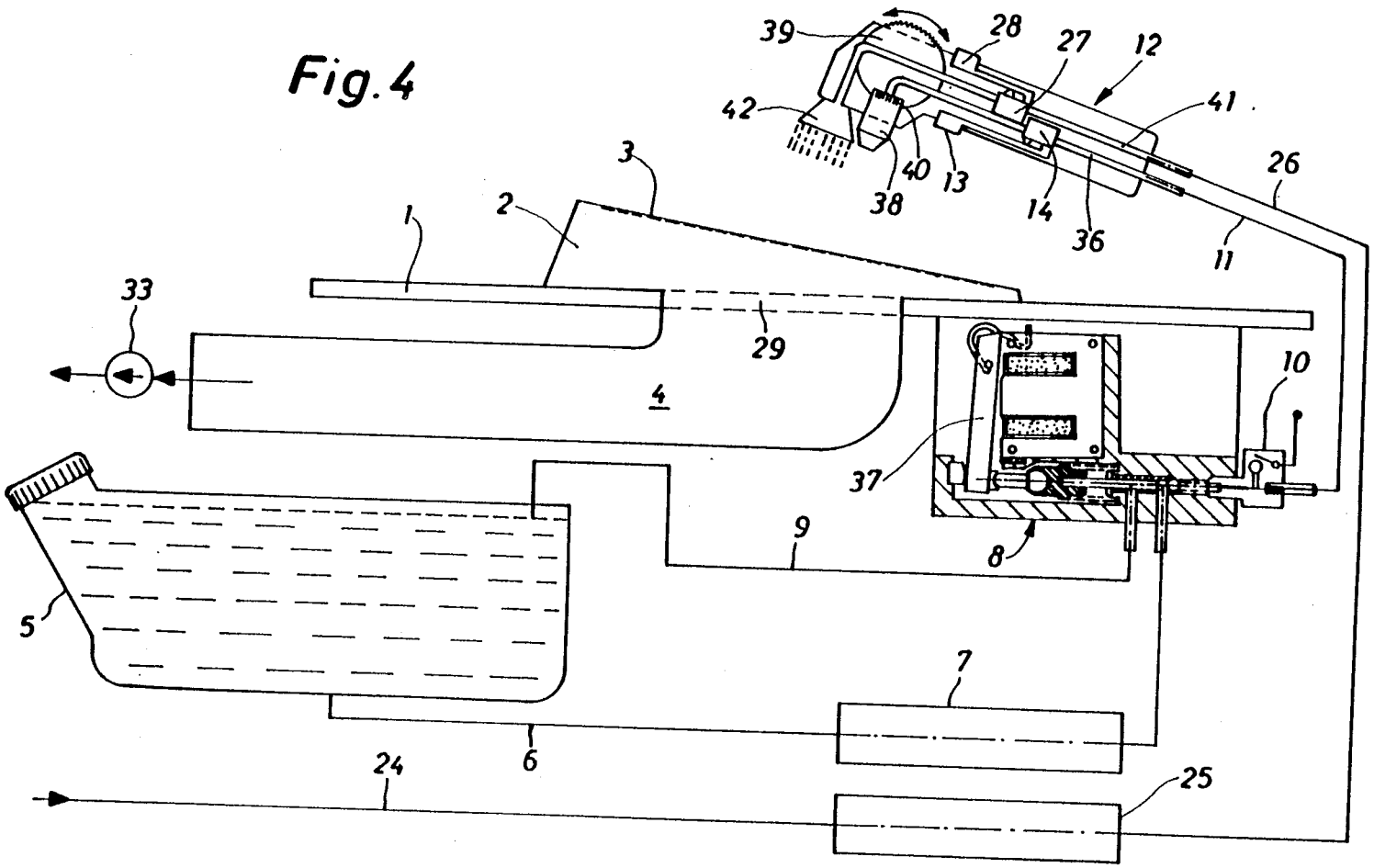
FIG. 4 illustrates schematically a further embodiment of an apparatus in accordance with the invention and for practising the method in accordance with the invention.

Referring to the embodiments in accordance with FIGS. 1 and 4 a pressurized air line 26 extends from the air heating device 25 also to the treatment tool 12 and is also provided with a shut-off device 27 located in the treatment tool 12, which shut-off device 27 is controlled by a third push button 28.

The pressure of the liquids exiting out of the respective treatment tool is, for instance, in the range between two MPa and four MPa. The liquids can be heated in the heating devices 7, 18 up to a temperature of about 90° C. The pressure of the air exiting out of the slot shaped jet nozzle 31, which will be described later, is in this embodiment in the range from 3 to 6 bar and in case the air ejected at the jet nozzle is hot air, the temperature thereof can amount to 100° C.

A first embodiment of the manually operable treatment tool 12 is illustrated in FIGS. 2 and 3. The tool includes a discharge head 15. This discharge head 15 includes a jet nozzle 31 in form of a slot, through which the hot pressurized air exits. This slot shaped jet nozzle 31 is arranged such that the discharge head 15 including the slot shaped jet nozzle 31 can be directly placed onto a respective area of a textile article which is to be treated such that a lateral escaping of the air jet is not possible and, therefore, the hot air penetrates at its full pressure and completely the corresponding area, i.e. flows as jet therethrough. Alternatively, the slot shaped jet nozzle 31 may be surrounded by a projecting ring such that the jet nozzle 31 is somewhat recessed in the discharge head 15. The two jet nozzles 32, 34, i.e. exits, for the liquid including a cleaning agent and for the water are placed aside of the slotted jet nozzle 31 in the discharge head 15. The angle of the fan formed by these exiting jets of the prevailing liquids can be adjusted. Preferably, the fan angle of the liquid which contains the cleaning agent is kept smaller than the angle of the fan of the jet of the water (both having the same pressure), such that the liquid which contains the cleaning agent forms the sharper jet.

In order now to remove the stain the soiled area of the textile article is placed onto the pedestal 2, i.e. onto the wire mesh 3, whereby the drawing off, i.e. the application of the subatmospheric pressure via the suction channel 4, may already be operative. Thereafter the operator rakes the treatment tool 12, which, for instance, may be stored hanging on a hook or may simply be lying on the working table, into his hand, whereby it shall be noted additionally, that the lines 11, 21 through which the liquids are fed as well as the pressurized air line 26 are made of a flexible material. The treatment tool 12, i.e. obviously the nozzles through which the prevailing liquids or air exit, is directed against the article placed onto the wire mesh 3, and by preSSing the push button 22 initially the liquid containing the cleaning agent is jetted at a high pressure in shape of a pulsating jet against the soiled area. This sharp liquid jet impinges onto the e.g. weaving such that the soil is dissolved by the cleaning agent present in the liquid and furthermore that this weaving is worked mechanically, specifically due to the pulsating nature of the jet. Due to the pressure exerted by the liquid jet the dirt which has now been dissolved is rinsed out of the e.g. woven textile article and discharged through the suction channel 4. Thereafter the push button 13 is pressed and accordingly highly pressurized hot water is jetted in shape of a pulsating jet through the soiled area. This sharp water jet impinges also onto the textile article such that this is once more worked mechanically and additionally the cleaning agent is completely rinsed out of the article and also possible residual dirt is too rinsed out of the textile article and led off through the suction channel 4. Now this area which has been worked according to the above procedures is obviously damp such that it is quite difficult, when not even impossible, to determine if all dirt has been expelled therefrom.

Accordingly, the push button 13 is given free such that the feeding of pressurized water is interrupted and the treatment tool 12 placed directly in contact onto the textile material. The push button 28 is pressed and conclusively air, preferably hot air, is pressed through the corresponding area such that this damp area will dry practically immediately. In case the dirt has up to this instant not been completely removed from the article, it quite obviously will now become visible as soon as the article has been dried and if necessary, a further treatment in the sequence as set forth above can be carried out.

By means of such procedure the dirt spots can be removed from a respective planar textile article extremely speedily and simply, whereby a determining if a complete removal has taken place can be made immediately. Accordingly, an apparatus is provided, which can be operated very simply and allows a fast working. Additionally, the environmental hazards are done away with, and an environmentally correct disposing of the dirt dissolving agent is also no longer a problem to be coped with. Furthermore, no rings are formed at or around, respectively, the cleaned area and specifically the operating personnel is no longer exposed to the vapors of the solvents.

Figure 5:
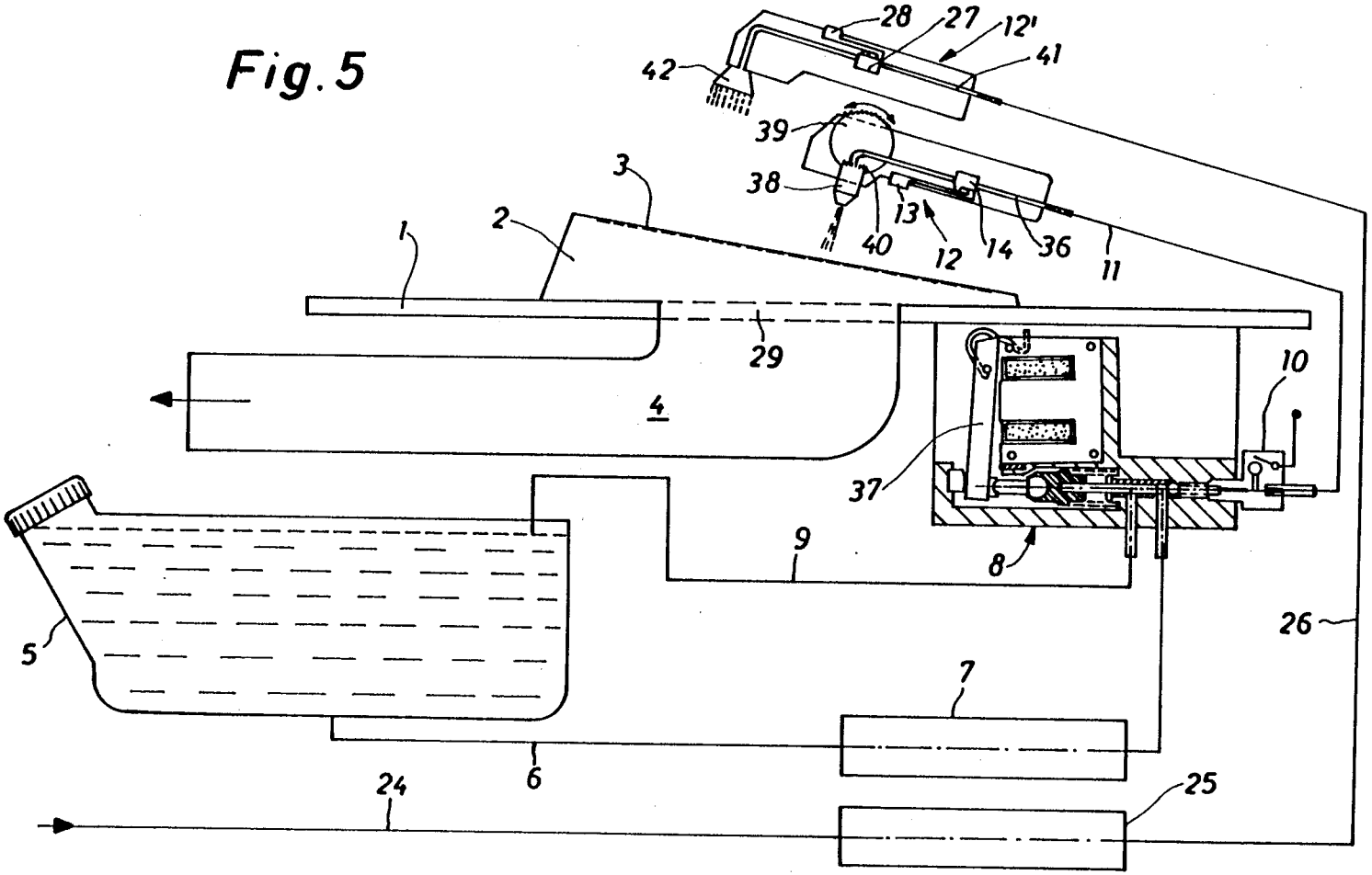
FIG. 5 illustrates a further apparatus for cleaning a planar textile article in accordance with the inventive method.

The embodiments of the apparatus illustrated in FIGS. 4 and 5 differ from those in accordance with FIGS. 1 to 3 primarily in that no cleaning liquid circuit is present and that merely air and water are used for the cleaning purposes. The working tool is also of a somewhat different design.

In accordance with the embodiment illustrated in FIG. 4 the pressurized water line 11 runs from the pump 8 to the treatment tool 12 and is connected thereat to a feed line 36. A shut-off device 14 to be operated by a push button 13 is mounted at this feed line 36. By operating the push button 13 the feeding of the hot pressurized water can be selectively switched on and switched off, respectively. After the shut-off device 14 the feed line 36 runs to a discharge piece 38, which is provided with an adjustable jet nozzle. The adjusting of this jet nozzle, i.e. of the size of the fan shape of the jet ejected out of that nozzle, proceeds via a control wheel 39 rotatably supported in the casing of the treatment tool 12, which control wheel 39 is knurled. This knurled control wheel 39 engages a toothed ring section of the discharge head 15 supported for rotation at the end of the feed line 36.

The pressurized air line 26 runs to the treatment tool 12 and ends at a pressurized air feed line 41. A shut-off device 27 is located at this pressurized air feed line, which shut-off device 27 is controlled by a push button 28. The feed line 41 ends finally at the discharge piece 42 of the treatment tool 12.

The operation of this embodiment of the apparatus is the same as such described with reference to FIGS. 1 to 3 with the exception of the treatment step which involves the use of a cleaning agent.

FIG. 5 discloses, finally, a modification, according to which the discharge piece 38 for pressurized water and the discharge piece 42 for pressurized air are located in a respective separate treatment tool 12 and 12', respectively. Accordingly, the operator of this apparatus can, depending if he is directing hot water for cleaning the textile article or dry air for drying the article against such article, take only one or the other treatment tool 12 or 12' into his hand. There is, furthermore, also the possibility to, in case the article which is to be cleaned is held rigid on the pedestal 2, grasp with one hand the treatment tool 12 and with the other hand the treatment tool 12' and accordingly, the operator can in case of several soiled areas or in case of a large soiled area carry out an exceedingly short time cleaning thereof.

While there are shown and described present preferred embodiments of the invention, it is to be distinctly understood that the invention is not limited thereto, but may be otherwise variously embodied and practiced within the scope of the following claims.

I claim:

1. A method of removing stains from a soiled area of a planar textile article, comprising the steps of placing a soiled area of a planar textile article in a stretched condition over a water and air penetratable support;

mechanically working said soiled area at least once by a jet consisting essentially of relatively highly pressurized liquid by directing said jet against said soiled area such as to cause said relatively highly pressurized essentially liquid jet to penetrate therethrough, whereby dirt which caused the staining is torn away from said stained area and is dragged along by said relatively highly pressurized essentially liquid jet; and immediately thereafter exposing said area to a jet consisting essentially of pressurized air such as to have the pressurized essentially air jet penetrate therethrough, whereby liquid is expelled and driven away from said area by the force of the pressurized essentially air jet and an immediate drying thereof is reached.

2. The method of claim 1, wherein an induced draught is applied at said water and air penetratable support acting in a direction which extends at least substantially parallel to the direction of the pressurized liquid jet and pressurized air jet.

3. The method of claim 1, wherein at least one said liquid is pressurized water.

4. The method of claim 1, wherein said mechanical working of the soiled area comprises an initial directing of a jet of a pressurized cleaning liquid having a low lathering power thereagainst followed by a directing of a jet of pressurized water thereagainst, which sequence is possibly repeated.

5. The method of claim 4, wherein the pressure exerted by the initial pressurized liquid jet onto the soil area is larger than the pressure of the pressurized water jet.

6. The method of claim 1, wherein the jet of the respective pressurized liquid is of a pulsating nature.

7. The method of claim 1, comprising a controlling of the temperature of a respective pressurized liquid.

8. The method of claim 1, wherein the air of said pressurized air jet is compressed to a pressure within the range of about 3–6 bar.

9. An apparatus for removing stains from a soiled area of a planar textile article, comprising a water and air penetratable support intended for supportingly receiving a soiled area of a textile article;

a means for producing and discharging a jet consisting essentially of relatively highly pressurized hot water directed against the soiled area of such textile article stretched over said support whereby dirt which caused the staining is torn away from said stained area and is dragged along by said relatively highly pressurized essentially liquid jet;

means for producing and discharging a jet consisting essentially of pressurized air directed against said area of such textile article placed onto said support whereby liquid is expelled and driven away from said area by the force of the pressurized essentially air jet and an immediate drying thereof is reached; and means for producing an induced draught operative to draw off at least the water which has been directed to said soiled area.

10. The apparatus of claim 9, in which said means for producing and discharging of a pressurized hot water jet comprises a pulsator operative to provide a pulsating hot water jet.

11. The apparatus of claim 9, in which said means for producing and discharging of a pressurized water jet comprises a head piece for the discharge of said pressurized water, and in which said means for producing and discharging of a pressurized air jet comprises further a head piece for the discharge of said pressurized air, which water discharge head piece and which air discharge head piece are each connected to a respective feed line and mounted in a manually operable treatment tool.

12. The apparatus of claim 11, in which said water discharge piece and said air discharge piece are mounted in a common treatment tool.

13. The apparatus of claim 11, in which both said feed lines include a shut-off means to be operated by a respective push button allowing a selective discharging of water and/or air.

14. The apparatus of claim 9, in which said means for producing and discharging pressurized air comprises a heating device intended for heating said pressurized air.

15. The apparatus of claim 9, in which said means for producing and discharging of a pressurized hot water jet comprises a water tank, a heating device and a pulsating pumping device, which heating device is located upstream of said pulsating pumping device.

16. The apparatus of claim 15, in which said pulsating pumping device comprises a diaphragm pump or a piston pump.

17. An apparatus for removing stains from a soiled area of a planar textile article, comprising a water and air penetratable support intended for supportingly receiving a soiled area of a textile article;

at least one means for producing and discharging a jet consisting essentially of relatively highly pressurized liquid directed against the soiled area of the textile article stretched over said support whereby dirt which caused the staining is torn away from said area and is dragged along by said relatively highly pressurized essentially liquid jet;

a means for producing and discharging a jet consisting essentially of pressurized air directed against said area of such textile article placed onto said support whereby liquid is expelled and driven away from said area by the force of the pressurized essentially air jet and an immediately drying thereof is reached.

18. The apparatus of claim 17, comprising further a means for producing an induced draught at said support and acting in a direction which extends at least substantially parallel to the direction of the respective pressurized liquid jet and pressurized air jet.

19. The apparatus of claim 17, in which said at least one means for producing and discharging of a respective jet of a pressurized liquid comprises a pulsator operative to provide a pulsating pressurized liquid jet.

20. The apparatus of claim 19, in which each respective means for producing and discharging of a respective jet of a pressurized liquid comprises a heating device operative for heating a respective pressurized liquid.

21. The apparatus of claim 20, in which each respective means for producing and discharging of a respective jet of a pressurized liquid comprises a storage tank and in which said pulsator comprises a pulsating pump located downstream of said heating device.

22. The apparatus of claim 17, in which each respective means for producing and discharging of a respective jet of a pressurized liquid comprises a jet nozzle and in which said means for producing and discharging of a pressurized air jet comprises a jet nozzle in shape of a slot, which respective jet nozzles are located in a common operating housing.

23. The apparatus of claim 22, in which every jet nozzle is connected to one respective feed line which includes a shut-off means to be operated by a respective push button allowing a selective discharging of a liquid and/or air.

24. The apparatus of claim 17, in which one pressurized liquid is water.

25. The apparatus of claim 17, in which a further pressurized liquid comprises a cleaning liquid having a low lathering power.

26. The apparatus of claim 17, in which each respective means for producing and discharging of a respective jet of a pressurized liquid comprises a diaphragm pump or a piston pump.

* * * * *